United States Patent [19]

Katsuno et al.

[11] Patent Number: 5,035,358

[45] Date of Patent: Jul. 30, 1991

[54] FUEL INJECTOR FOR USE IN AN ENGINE

[75] Inventors: Toshiyasu Katsuno, Susono; Satoshi Iguchi; Yoshiki Chujo, both of Mishima, all of Japan

[73] Assignee: Toyota Jidosha Kabushiki Kaisha, Cichi, Japan

[21] Appl. No.: 496,549

[22] Filed: Mar. 20, 1990

[30] Foreign Application Priority Data

Mar. 22, 1989 [JP] Japan ..... 1-31395[U]
Apr. 12, 1989 [JP] Japan ..... 1-42016[U]

[51] Int. Cl.[5] ..... F02M 61/18; F02M 69/00

[52] U.S. Cl. ..... 239/403; 239/405; 239/409; 239/429; 239/432; 239/433; 239/585

[58] Field of Search ..... 239/403, 405, 408–410, 239/429, 432, 433, 533.12, 585

[56] References Cited

U.S. PATENT DOCUMENTS

| | | | |
|---|---|---|---|
| 3,782,639 | 1/1974 | Boltz et al. | 239/533.12 |
| 4,519,370 | 5/1985 | Iwata | 239/533.12 |
| 4,566,634 | 1/1986 | Wiegand | 239/410 |
| 4,828,181 | 5/1989 | Singels-Craenen | 239/405 |

FOREIGN PATENT DOCUMENTS

| | | | |
|---|---|---|---|
| 52-59218 | 5/1977 | Japan . | |
| 57-126556 | 8/1982 | Japan . | |
| 59-7772 | 1/1984 | Japan . | |
| 62-186112 | 8/1987 | Japan . | |
| 63-183372 | 11/1988 | Japan . | |
| 409211 | 4/1934 | United Kingdom | 239/403 |

OTHER PUBLICATIONS

Toyota Technical Publication No. 3063, (Publication date: Feb. 27, 1989).

*Primary Examiner*—Andres Kashnikow
*Assistant Examiner*—Karen B. Merritt
*Attorney, Agent, or Firm*—Kenyon & Kenyon

[57] ABSTRACT

A fuel injector comprising a pair of air passages which are joined at the nozzle opening, whereby fuel injected from the fuel supply bore is joined with the airstreams flowing in the air passages. At this time, the fuel is carried by the airstreams and thus flows through the air passages at a high speed, and accordingly, the fuel is caused to impinge against the inner wall of the nozzle opening at a high speed.

13 Claims, 7 Drawing Sheets

FUEL INJECTOR FOR USE IN AN ENGINE

BACKGROUND OF THE INVENTION

1. Field of the Invention

The present invention relates to a fuel injector for use in an engine.

2. Description of the Related Art

In a known high pressure fuel injector, fuel injected from a fuel supply bore arranged in the injector housing is divided to flow into a pair of branch passages formed in the injector housing. The fuel injector has a nozzle opening formed on the tip portion thereof, and the branch passages are joined at the nozzle opening. The fuel flows in the branch passages are caused to collide with each other in the nozzle opening, to promote the vaporization of fuel injected from the nozzle opening (see Japanese Unexamined Patent Publication No. 52-59218).

In this fuel injector, however, if the injection pressure of fuel injected from the fuel supply bore is lowered, when the fuel flows in the branch passages collide with each other, the fuel droplets are not divided into fine particles but are joined together, and as a result, a problem arises in that it is impossible to promote the atomization of fuel injected from the nozzle opening.

SUMMARY OF THE INVENTION

An object of the present invention is to provide a fuel injector capable of promoting the vaporization of fuel injected from the nozzle opening even if the injection pressure of fuel injected from the fuel supply bore is lowered.

According to the present invention, there is provided a fuel injector comprising: a housing body; a fuel supply bore for injecting fuel into an interior of said housing body; a nozzle opening arranged on a common axis with said fuel supply bore and always open to an exterior of the housing body to inject both fuel and air into the exterior of the housing body; an air passage filled with an air having a pressure higher than a pressure in the exterior of the housing body; a joining portion formed in the housing for joining the fuel injected from the fuel supply bore with the air fed from the air passage to cause the fuel to be carried by the air; a fuel air passage formed in the housing and extending between the joining portion and the nozzle opening to cause both the air and the fuel carried by the air to move toward the nozzle opening; the fuel air passage extending obliquely relative to an axis of the nozzle opening and comprising a pair of fuel air passages, with corresponding joining portions, symmetrically arranged with respect to the common axis and joined in the nozzle opening, the fuel injected from the fuel and an impingement wall formed in by an inner circumferential wall of the nozzle opening, the fuel air passage extending toward the impingement wall to cause the air and fuel to impinge against the impingement wall.

The present invention may be more fully understood from the description of preferred embodiments of the invention set forth below, together with the accompanying drawings.

DESCRIPTION OF PREFERRED EMBODIMENTS

Figure 1:
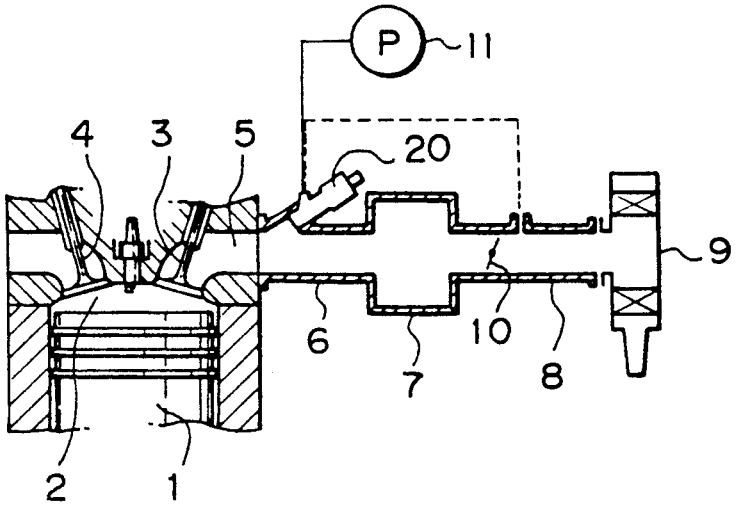
FIG. 1 is a cross-sectional side view of an engine.

Referring to FIG. 1, reference numeral 1 designates a piston, 2 a combustion chamber, 3 an intake valve, 4 an exhaust valve, and 5 an intake port. The intake port 5 is connected to a surge tank 7 via a corresponding branch pipe 6, and the surge tank 7 is connected to an air cleaner 9 via an intake duct 8 having a throttle valve 10 arranged therein. A fuel injector 20 is mounted on the branch pipe 6 to inject fuel into the corresponding intake port 5.

Figure 2:
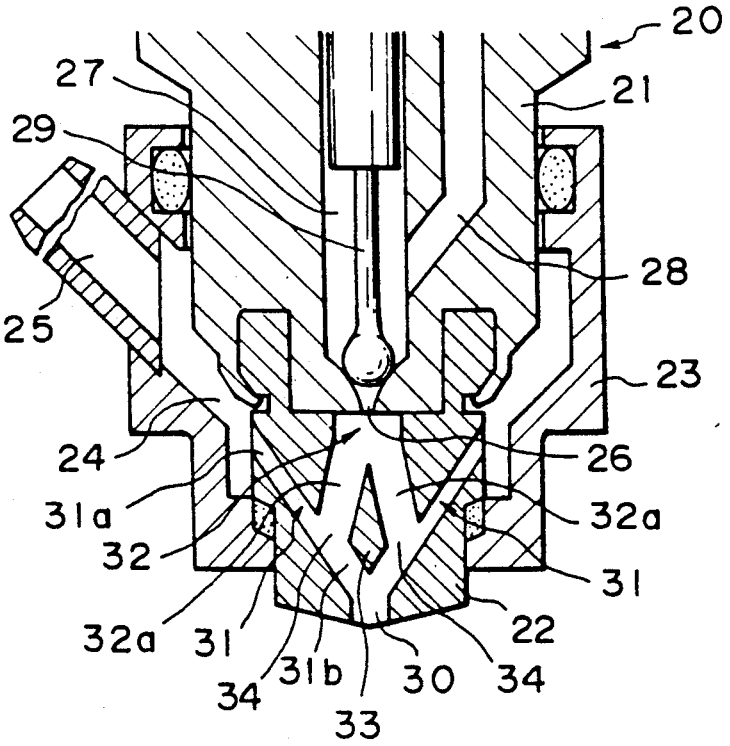
FIG. 2 is a cross-sectional side view of the tip portion of a fuel injector.

FIG. 2 illustrates the tip portion of the fuel injector 20 illustrated in FIG. 1.

Referring to FIG. 2, reference numeral 21 designates a housing of the fuel injector 20, 22 a nozzle member fixed to the tip end of the housing 21, and 23 a cap member arranged to cover the outer circumferential wall of the nozzle member 22. An annular air chamber 24 is formed between the cap member 23 and the outer circumferential wall of the nozzle member 22, and the air inlet 25 of the air chamber 24 is connected to the air pump 11 driven by the engine, as illustrated by the solid line in FIG. 1, or to the intake duct 8 upstream of the throttle valve 10, as illustrated by the broken line in FIG. 1. A fuel supply bore 26 is formed on the tip end face of the housing 21 on the axis of the housing 21, and a needle bore 27 connected to the fuel supply bore 26 is formed in the housing 21. Fuel under a low pressure is fed into the needle bore 27 from a fuel supply passage 28. A needle 29 actuated by the solenoid (not shown) is arranged in the needle bore 27 to control the opening operation of the fuel supply bore 26, and when the needle 29 opens the fuel supply bore 26, the fuel under a low pressure is injected from the fuel supply bore 26.

A nozzle opening 30, which is always open for injecting both fuel and air therefrom, is formed on the tip end face of the nozzle member 22 and arranged coaxially with the fuel supply bore 26. A pair of passages 31 are formed in the nozzle member 22 and extended straight from the air chamber 24 to the nozzle opening 30 while approaching each other. These passages 31 are symmetrically arranged with respect to the axis of the nozzle member 22 and are joined at the nozzle opening 30. A fuel flow passage 32 is formed in the inner end portion of the nozzle member 22, and the fuel supply bore 26 is open to the fuel flow passage 32. This fuel flow passage 32 is divided into a pair of fuel flow passages 32*a* arranged such that the distance therebetween is increased toward the tip end face of the nozzle member 22. These fuel flow passages 32*a* are symmetrically arranged with respect to the axis of the nozzle member 22 and jointed with the corresponding passages 31. Consequently, a wedge-shaped separating wall 33 is formed between the fuel flow passages 32*a*. As mentioned above the air chamber 24 is connected to the air pump 11 or the intake duct 8 upstream of the throttle valve 10, and the nozzle opening 30 is always open to the interior of the branch pipe 6. In this case, the pressure acting on the nozzle opening 30 is lower than the pressure in the air chamber 24, and thus air in the air chamber 24 continuously flows into the nozzle opening 30 via the passages 31. That is, assist air continuously flows within the passages 31 toward the nozzle opening 30. Fuel flows in the fuel flow passages 32*a* are joined with the assist air at the joining portions 34 of the fuel flow passages 32*a* and the passages 31, and the fuels then flow toward the nozzle opening 30 together with the assist air. Consequently, the portion of the passage 31 between the air chamber 24 and the joining portion 34 forms an assist air passage 31*a* in which only assist air flows, and the portion of the passage 31 between the joining portion 34 and the nozzle opening 30 forms a fuel air passage 31*b* in which both fuel and assist air flow. Consequently, the fuel injected from the fuel supply bore 26 is joined with the assist air at the joining portions 34 after being divided at the fuel flow passages 32*a*. When the fuel is joined with the assist air, the fuel is carried by the assist air and thus caused to flow within the fuel air passages 31*b* at a high speed, together with the assist air. Then the fuel is injected from the nozzle opening 30 together with the assist air.

The velocity of the fuel injected from the fuel supply bore 26 drops immediately after being injected, and thus the velocity of the assist air flowing within the passages 31 is considerably higher than the velocity of the fuel injected from the fuel supply bore 26. Therefore, when the fuel is joined with the assist air at the joining portions 34, the velocity of the fuel is immediately increased by the assist air, and thus the fuel is caused to flow within the fuel air passages 31*b* together with the assist air at a speed which is considerably higher than the speed of the fuel shortly after the fuel is injected from the fuel supply bore 26. Consequently, if the assist air is caused to impinge against a stationary wall in the fuel air passages 31*b*, the fuel droplets are caused to impinge against the stationary wall at a considerably higher speed, compared with the case wherein the fuel injected from the fuel supply bore 26 is directly impinged against a stationary wall. As a result, the vaporization of the fuel can be considerably promoted. In the embodiment illustrated in FIG. 2, if one of the passages 31 is removed, the fuel and the assist air, which flow within the fuel air passage 31*b*, impinge against the inner circumferential wall of the nozzle opening 30, and thus in this case the inner circumferential wall of the nozzle opening 30 forms an impingement wall against which the fuel and the assist air impinge. The concept of causing the fuel droplets to be carried by the assist air and then impinge against the impingement wall as mentioned above is the basic feature of the present invention.

In the embodiment illustrated in FIG. 2, this basic concept is improved, and the fuel and the assist air flowing in both fuel air passages 31*b* are caused to impinge against each other in the nozzle opening 30. Consequently, since the relative velocity of the fuel droplets is further increased at the time of impingement, and a strong shearing force is give to the fuel droplets by the assist air, the atomization of fuel is further promoted. In addition, since the fuel joined with the assist air at the joining portions 34 is immediately carried and conveyed by the assist air, there is no danger that the fuel will adhere to the inner walls of the fuel air passages 31*b*. Consequently, since the fuel injected from the fuel supply bore 26 is instantaneously injected from the nozzle opening 30 without accumulating in the nozzle member 22, a good accelerating operation of the engine can be obtained.

FIGS. 3 through 14 illustrate various embodiments. In these embodiments, similar components having similar functions are indicated by the same reference numerals used in FIGS. 1 and 2, so that the present invention can be easily understood.

Figure 3:
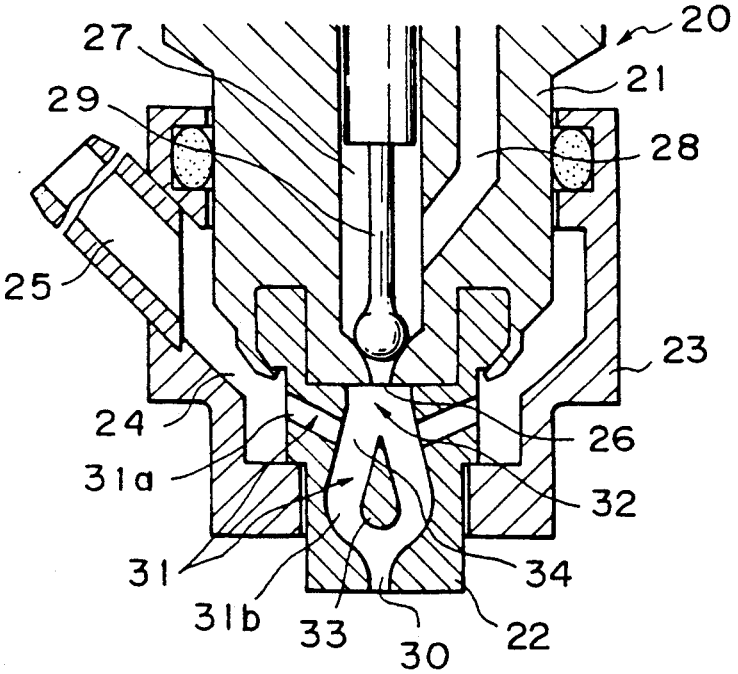
FIG. 3 is a cross-sectional side view of another embodiment of the tip portion of a fuel injector.

In the embodiment illustrated in FIG. 3, the assist air passages 31*a* are open to the corresponding passages 31 toward the upper end portion of the separating wall 33, and further, the fuel air passages 31*b* are smoothly curved.

If the amount of fuel injected from the fuel supply bore 26 is increased, there is a danger that the fuel will adhere to the upper end portion of the separating wall 33, and thus it is difficult to obtain a good response in an accelerating operation. Therefore, in this embodiment, the assist air passages 31*a* are open to the passages 31 toward the upper end portion of the separating wall 33, so that fuel adhering to the upper end portion of the separating wall 33 is blown off by the assist air flowing in from the assist air passages 31*a*. Also, the fuel air passages 31*b* are smoothly curved to reduce the flow resistance thereof, so that the impingement energy of the fuel droplets at the nozzle opening 30 is not reduced by a reduction in the velocity of the fuel and the assist air, which reduction occurs during the time these elements flow in the fuel air passages 31*b*.

Figure 4:
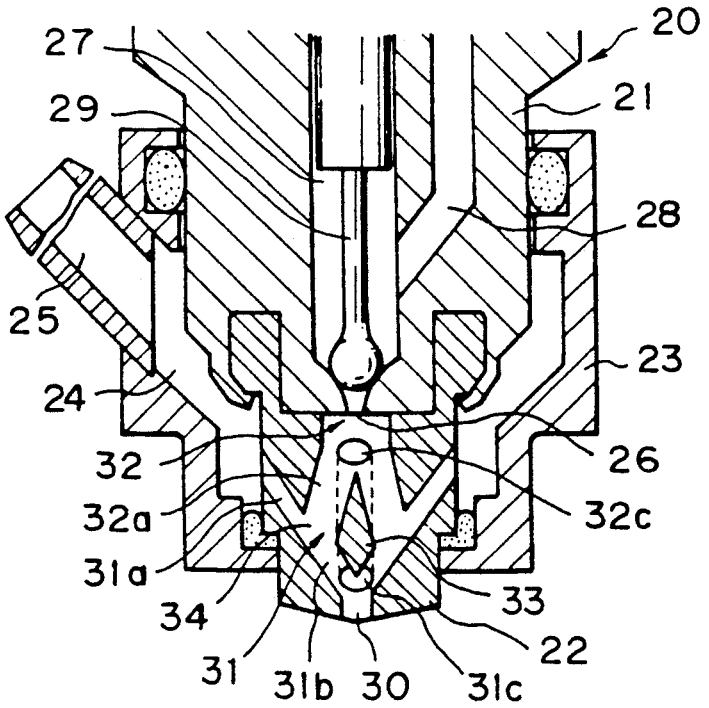
FIG. 4 is a cross-sectional side view of a further embodiment of the tip portion of a fuel injector.

In the embodiment illustrated in FIG. 4, in addition to a pair of the combinations of the fuel flow passage 32*a* and the fuel air passage 31*b*, another combination of a fuel flow passage 32*c* and a fuel air passage 31*c* is additionally formed in the plane including the axis of the fuel injector 20 and perpendicular to the plane in which the fuel flow passages 32*a* and the passages 31 are arranged.

Where a pair of the passages 31 is arranged in the same plane as illustrated in FIG. 2, the spray of fuel injected from the nozzle opening 30 has an ellipsoidal cross-sectional shape. In the embodiment illustrated in FIGS. 4, the additional fuel flow passage 32*c* and fuel air passage 31*c* are provided so that the cross-sectional shape of the spray of fuel injected from the nozzle opening 30 becomes as close to a circular shape as possible.

Figure 5:
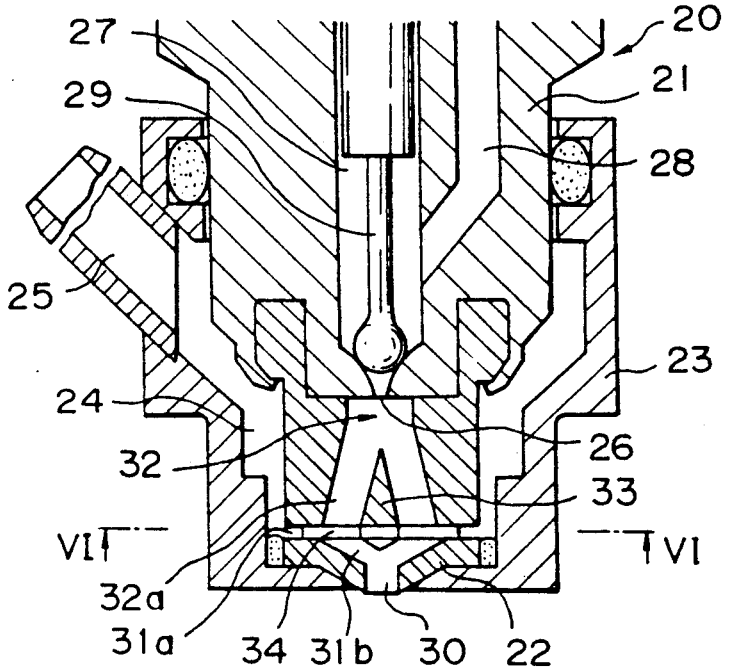
FIG. 5 is a cross-sectional side view of a still further embodiment of the tip portion of a fuel injector.
Figure 6:
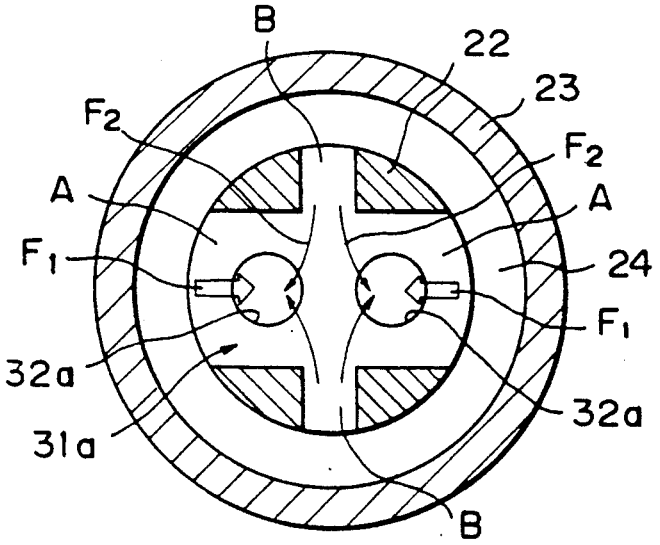
FIG. 6 is a cross-sectional view taken along the line VI—VI in FIG. 5.

In the embodiment illustrated in FIGS. 5 and 6, the assist air passage 31*a* comprises a first wide assist air passage A extending through the separating wall 33 and the joining portions 34 of the fuel flowing passages 32*a* and the fuel flow passages 31*b*, and a second assist air passage B extending in the same plane as the first assist air passage A and intersecting the first assist air passage A at a right angle. In this embodiment, although a large amount of the assist air flows into the fuel flow passages 31*b* via the first assist air passage A as illustrated by the arrows Fl in FIG. 6, a part of the assist air flows into the fuel flow passages 31*b* via the second assist air passage B, from inward as illustrated by the arrows F2 in FIG. 6. Consequently, in this embodiment, the liquid fuel flowing down the separating wall 33 is flown off by the assist air, as illustrated by the arrows F2 in FIG. 6.

Figure 7:
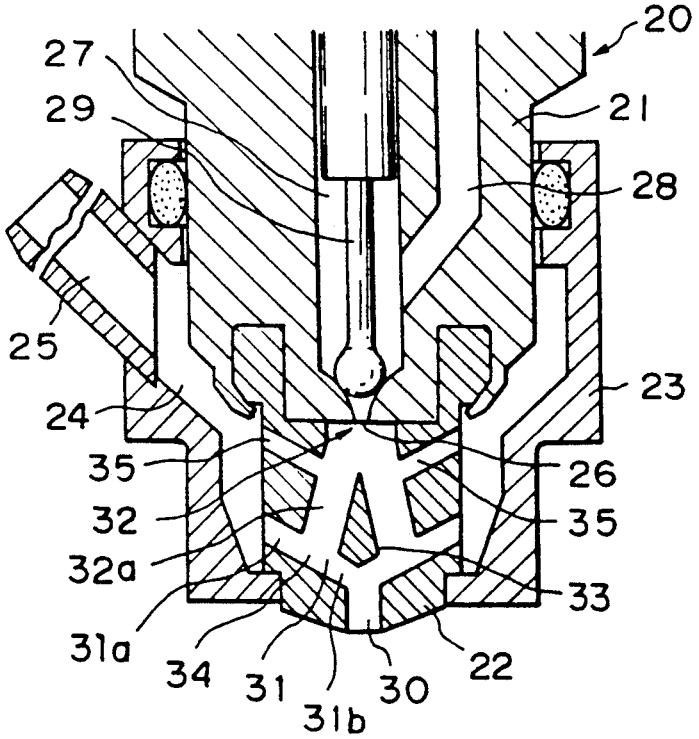
FIG. 7 is a cross-sectional side view of a still further embodiment of the tip portion of a fuel injector.

In the embodiment illustrated in FIG. 7, in addition to a pair of the assist air passages 31*a*, another pair of assist air passages 35 is provided, and these assist air passages 35 are open to the corresponding fuel flow passages 32*a* toward the upper end portion of the separating wall 33. Consequently, in this embodiment, the fuel adhering to the upper end portion of the separating wall 33 is blown off by the assist air flowing out of the assist air passages 35.

Figure 8:
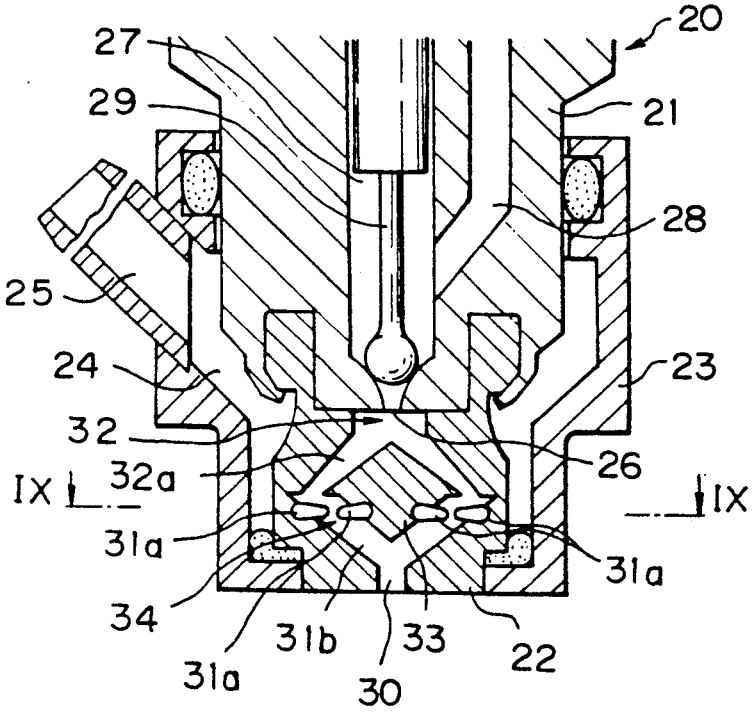
FIG. 8 is a cross-sectional side view of a still further embodiment of the tip portion of a fuel injector.
Figure 9:
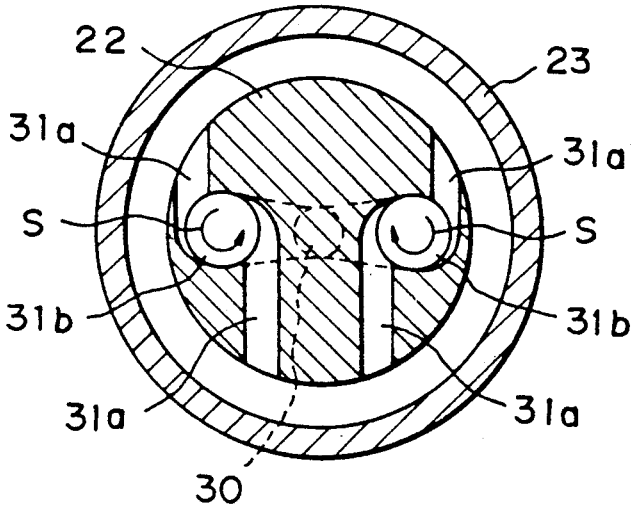
FIG. 9 is a cross-sectional view taken along the line IX—IX in FIG. 8.

In the embodiment illustrated in FIGS. 8 and 9, each of the assist air passages 31*a* comprises a pair of assist air passages which are tangentially connected to the inner circumferential wall of the corresponding fuel air passage 31*b* at the joining portion of the fuel flowing passage 32*a* and the fuel flow passage 31*b*, so that the openings of the paired assist air passages 31*a* are directed toward the same circumferential direction. As illustrated in FIG. 9, the assist air passages 31*a* are symmetrically arranged with respect to a plane perpendicular to the plane in which the fuel flow passages 31*b* are formed, and thus as illustrated by the arrows S in FIG. 9, swirl motions in opposite directions are created in the fuel flow passages 31*b*, respectively. As mentioned above, in this embodiment, since a swirl motion is given to the assist air flowing within the fuel flow passages 31*b*, a strong shearing force is given to the fuel droplets by the assist air, and thus it is possible to further promote the vaporization of the fuel. In addition, since the swirling assist airstreams are joined in the nozzle opening 30, a strong turbulence is created, and thus it is possible to further promote the vaporization of the fuel.

Figure 10:
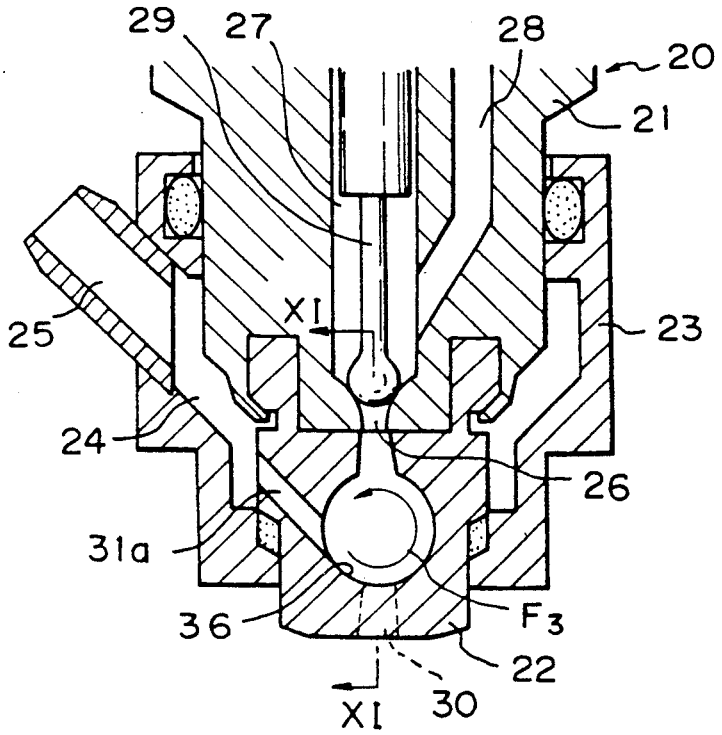
FIG. 10 is a cross-sectional side view of a still further embodiment of the tip portion of a fuel injector.
Figure 11:
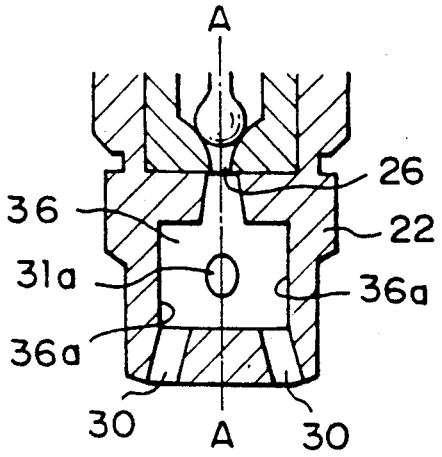
FIG. 11 is a cross-sectional view taken along the line XI—XI in FIG. 10.

In the embodiment illustrated in FIGS. 10 and 11, a cylindrical shape assist air swirl chamber 36 is formed in the nozzle member 22, and the fuel is injected from the fuel supply bore 26 toward the central portion of the assist air swirl chamber 36. The assist air passage 31*a* is tangentially connected to the cylindrical inner circumferential wall of the assist air swirl chamber 36, and thus a swirl motion F3 (FIG. 10) swirling in the plane A—A in FIG. 11 is created in the assist air swirl chamber 36. As illustrated in FIG. 11, in this embodiment, the nozzle opening 30 comprises a pair of nozzle openings symmetrically arranged with respect to the plane A—A, at a position furthest from the plane A—A, and thus the assist air flows out from the assist air swirl chamber 36 after being sufficiently swirled in the assist air swirl chamber 36.

The velocity of the outer periphery of the swirl motion of the assist air in the assist air swirl chamber 36 is the highest, and in this embodiment the fuel is injected from the fuel supply bore 26 toward the outer periphery of the swirl motion, which swirls at the highest speed. As a result, since the fuel droplets are subjected to a strong shearing force due to the swirling assist air, the vaporization of the fuel is considerably promoted. Then, the fuel droplets carried by the assist air are caused to impinge against the opposed end walls 36*a* of the assist air swirl chamber 36. At this time, the velocity of the assist air is very high, and thus since the assist air impinges against the opposed end walls 36*a* of the assist air swirl chamber 36 at a high speed, it is possible to further promote the variation of the fuel. Then the fuel is injected from the nozzle openings 30 together with the assist air.

Figure 12:
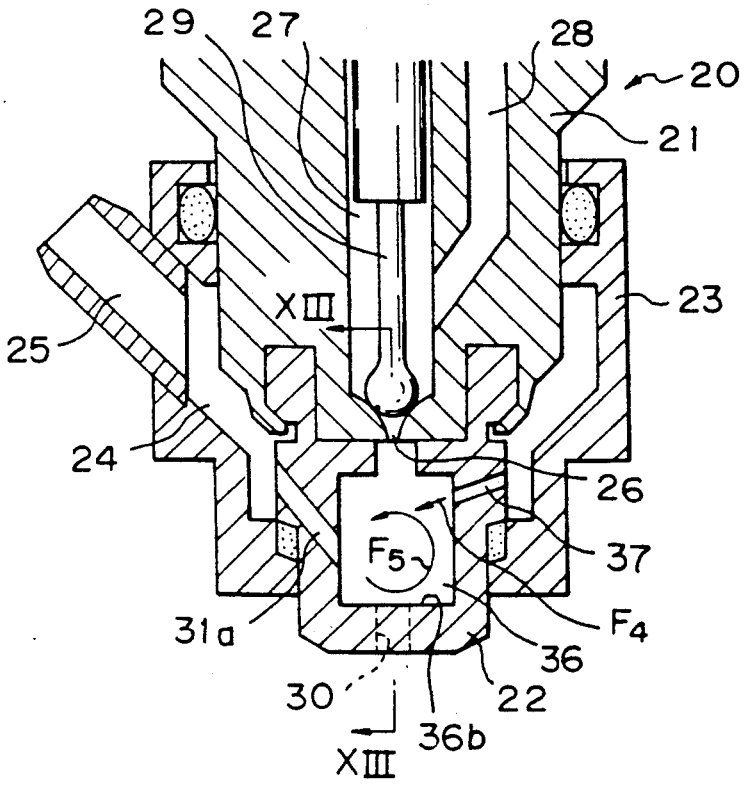
FIG. 12 is a cross-sectional side view of a still further embodiment of the tip portion of a fuel injector.
Figure 13:
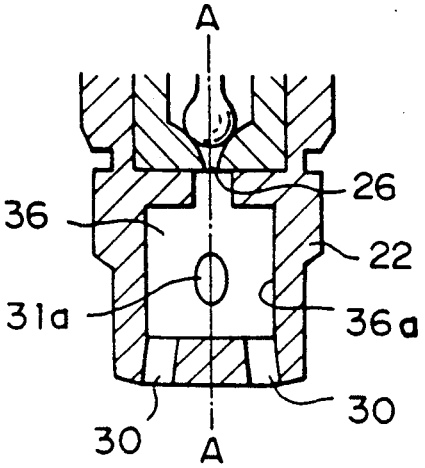
FIG. 13 is a cross-sectional view taken along the line XIII—XIII in FIG. 12.

In the embodiment illustrated in FIGS. 12 and 13, the assist air swirl chamber 36 has a rectangular cross-sectional shape, and in addition to the assist air passage 31*a*, another assist air passage 37 is provided. The assist air passage 31*a* has a cross-sectional area which is larger than that of the assist air passage 37, and the opening of the assist air passage 31*a* is directed toward the central portion of the bottom wall 36*b* of the assist air swirl chamber 36. Conversely, the opening of the assist air passage 37 is directed toward the upper interior of the assist air swirl chamber 36.

In this embodiment, the assist air flowing out from the assist air passage 31*a* moves upward along the side wall of the assist air swirl chamber 36 after flowing along the bottom wall 36*b*. Then, as illustrated by the arrow $F_5$ in FIG. 12, since the flow direction of the assist air is deflected inward by the assist air flowing out from the assist air passage 37, a swirl motion $F_5$ swirling in the plane A—A in FIG. 13 is created in the assist air swirl chamber 36. Then, since the fuel droplets carried by the swirling assist air are caused to impinge against the opposed end walls 36*a* of the assist air swirl chamber 36, it is possible to promote the vaporization of the fuel.

Figure 14:
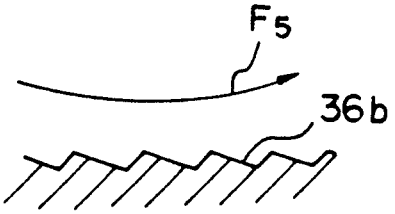
FIG. 14 is an enlarged cross-sectional side view of the bottom wall of the assist air swirl chamber.

In addition, also in this embodiment, since the fuel is injected from the fuel supply bore 26 toward the outer periphery of the swirl motion, which swirls at the highest speed, the vaporization of the fuel can be further promoted. Furthermore, in this embodiment, since the assist air $F_4$ flowing out from the assist air passage 37 comes into violent contact with the assist air $F_5$, a strong turbulence is created in the outer periphery of the swirl motion $F_5$, and thus the vaporization of the fuel is further promoted by this strong turbulence. In addition, to give a further strong turbulence to the outer periphery of the swirl motion $F_5$, the inner wall, for example, the bottom wall 36*b* of the assist air swirl chamber 36 may be formed so that it has a rough surface as illustrated in FIG. 14. In addition, although the assist air swirl chamber 36 is formed in the nozzle member 22 in the embodiments illustrated in FIGS. 10 and 12, the assist air swirl chamber 36 may be formed in the housing 21.

According to the present invention, by causing the fuel droplets to be carried by the assist air flowing at a high speed and then by causing these fuel droplets to impinge against the impingement wall at a high speed, it is possible to promote the vaporization of the fuel.

While the invention has been described by reference to specific embodiments chosen for purposes of illustration, it should be apparent that numerous modifications could be made thereto by those skilled in the art without departing from the basic concept and scope of the invention.

We claim:

1. A fuel injector comprising:

a housing body;

a fuel supply bore for injecting fuel into an interior of said housing body;

a nozzle opening arranged on a common axis with said fuel supply bore and always open to an exterior of said housing body to inject both fuel and air into the exterior of said housing body;

an air passage filled with an air having a pressure higher than a pressure in the exterior of said housing body;

a joining portion formed in said housing body for joining the fuel injected from said fuel supply bore with the air fed from said air passage to cause the fuel to be carried by the air;

a fuel air passage formed in said housing body and extending between said joining portion and said nozzle opening to cause both the air and the fuel carried by the air to move toward said nozzle opening, said fuel air passage extending obliquely relative to an axis of said nozzle opening and comprising a pair of fuel air passages, with corresponding joining portions, symmetrically arranged with respect to said common fix and joined in said nozzle opening, the fuel injected from said fuel supply bore being fed into both said fuel air passages at said corresponding joining portions; and an impingement wall formed by an inner circumferential wall of said nozzle opening, said fuel air passage extending toward said impingement wall to cause the air and fuel to impinge against said impingement wall.

2. A fuel injector according to claim 1, wherein said air passage comprises a pair of air passages connected to said corresponding fuel flow passages at said corresponding joining portions and aligned with said corresponding fuel flow passages.

3. A fuel injector according to claim 1, wherein said fuel supply bore is open to a fuel flow passage formed on said common axis in said housing, and said fuel flow passage is divided into a pair of fuel flow passages separated by a separating wall and extending to said corresponding joining portions symmetrically with respect to said common axis.

4. A fuel injector according to claim 3, wherein said air passage comprises pair of air passages which are open to said corresponding joining portions toward an upper end portion of said separating wall.

5. A fuel injector according to claim 4, wherein both said fuel flow passages are bent.

6. A fuel injector according to claim 3, wherein another fuel flow passage and another fuel flow passage are provided and extend in a plane including said common axis and perpendicular to a plane in which said pair of fuel flow passages are arranged.

7. A fuel injector according to claim 1, wherein said air passage is open to said joining portion over an entire periphery of said joining portion.

8. A fuel injector comprising:

a housing body;

a fuel supply bore for injecting fuel into an interior of said housing body, said fuel supply bore being open to a fuel flow passage formed in said housing body and divided into a pair of flow passages by a separating wall;

a nozzle opening which is always open to an exterior of said housing body to inject both fuel and air into the exterior of said housing body;

an air passage filled with an air having a pressure higher than a pressure in the exterior of said housing body, said air passage comprising a plurality of air passages;

a joining portion formed in said housing body for joining the fuel injected from said fuel supply bore with the air fed from said air passage to cause the fuel to be carried by the air, said joining portion comprising a plurality of joining portions, one of said air passages being open to one of said flow passages at one of said joining portions toward an upper end portion of said separating wall;

a fuel air passage formed in said housing body and extending between said joining portion nd said nozzle opening to cause both the air and the fuel carried by the air to move toward said nozzle opening, said fuel air passage extending obliquely relative to an axis of said nozzle opening an d comprising a pair of fuel air passages, with corresponding joining portions, symmetrically arranged with respect to said common axis and joined in said nozzle opening, the fuel injected from said fuel supply bore being fed into both said fuel air passages at said corresponding joining portions; and an impingement wall formed by either one of said fuel air passages and said nozzle opening, said fuel air passages extending toward said impingement wall to cause the air and fuel to impinge against said impingement wall.

9. A fuel injector comprising:

a housing body;

a fuel supply bore for injecting fuel into an interior of said housing body;

a nozzle opening arranged on a common axis with said fuel supply bore, always open to an exterior of said housing body to inject both fuel and air into the exterior of said housing body;

an air passage filled with an air having a pressure higher than a pressure in the exterior of said housing body;

a joining portion formed in said housing body for joining the fuel injected from said fuel supply bore with the air fed from said air passage to cause the fuel to be carried by the air;

a fuel air passage formed in said housing body and extending between said joining portion and said nozzle opening to cause both the air and the fuel carried by the air to move toward said nozzle opening, said fuel air passage comprising a pair of fuel air passages, with corresponding joining portions, symmetrically arranged with respect to said common axis and joined in said nozzle opening, said air passage comprising at least one pair of air passages which are tangentially connected to the inner peripheral walls of said corresponding fuel air passages at said joining portions to create whirl motions of the air in opposite directions in said fuel air passages; and an impingement wall formed by either one of said fuel air passages and said nozzle opening, said fuel air passages extending toward said impingement wall to cause the air and fuel to impinge against said impingement wall.

10. A fuel injector according to claim 1, wherein said air passages are symmetrically arranged with respect to a plane including said common axis and perpendicular to a plane in which the pair of said fuel air passages are arranged.

11. A fuel injector comprising:

a housing body;

a fuel supply bore for injecting fuel into an interior of said housing body;

a nozzle opening which is always open to an exterior of said housing body to inject both fuel and air into the exterior of said housing body;

an air passages filled with an air having a pressure higher than a pressure in the exterior of said housing body;

a joining portion formed in said housing body for joining the fuel injected from said fuel supply bore with the air fed from said air passage to cause the fuel to be carried by the air;

a fuel air passage formed in said housing body and extending between said joining portion and said nozzle opening to cause both the air and the fuel carried by the air to move toward said nozzle opening, said fuel air passage being formed by a swirl chamber extending in an opposite direction from said joining portion and having opposed end portions, a bottom wall, and a rectangular cross-sectional shape, said nozzle opening comprising a pair of nozzle openings connected to the corresponding opposed end portions of said swirl chamber, said air passage being open to said whirl chamber at said joining portion toward said bottom wall to create a swirl motion of the air therein, the fuel being injected from said fuel supply bore toward an outer periphery of said swirl motion; and an impingement wall formed by said opposed end portions of said swirl chamber, said fuel air passage extending toward said impingement wall to cause the air and fuel to impinge against said impingement wall.

12. A fuel injector comprising:

a housing body;

a fuel supply bore for injecting fuel into an interior of said housing body;

a nozzle opening which is always open to an exterior of said ad housing body to inject both fuel and air into the exterior of said housing body;

an air passage filled with an air having a pressure higher than a pressure in the exterior of said housing body;

a joining portion formed in said housing body for joining the fuel injected from said fuel supply bore with the air fed from said air passage to cause the fuel to be carried by the air;

a fuel air passage formed in said housing body and extending between said joining portion and said nozzle opening to cause both the air and the fuel carried by the air to move toward said nozzle opening, said fuel air passage being formed by a swirl chamber extending in an opposite direction from said joining portion and having opposed end portions, said nozzle opening comprising a pair of nozzle openings connected to the corresponding opposed end portions of said swirl chamber, said air passage being open to said swirl chamber at said joining portion to create a swirl motion of the air therein, the fuel being injected form said fuel supply bore toward an outer periphery of said swirl motion;

an impingement wall formed by said opposed end portions of said swirl chamber, said fuel air passage extending toward said impingement wall to cause the air and fuel to impinge against said impingement wall; and another air passage for feeding air into an upper interior of said swirl chamber to strengthen said swirl motion.

13. A fuel injector comprising:

a housing body; 'a fuel supply bore for injecting fuel into an interior of said housing body;

a nozzle opening which is always open o an exterior of said housing body to inject both fuel and air into the exterior of said housing body;

an air passage filled with an air having a pressure higher than a pressure in the exterior of said housing body;

a joining portion formed in said housing body for joining the fuel injected from said fuel supply bore with the air fed from said air passage to cause the fuel to be carried by the air;

a fuel air passage formed in said housing body and extending between said joining portion and said nozzle opening to cause both the air and the fuel carried by the air to move toward said nozzle opening, said fuel air passage being formed by a swirl chamber extending in an opposite direction from said joining portion and having opposed end portions and a rough inner surface, said nozzle opening comprising a pair of nozzle openings connected to the corresponding opposed end portions of said swirl chamber, said air passage being open to said swirl chamber at said joining portion to create a swirl motion of the air therein, the fuel being injected from said fuel supply bore toward an outer periphery of said swirl motion; and an impingement wall formed by said opposed end portions of said swirl chamber, said fuel air passage extending toward said impingement wall to cause the air and fuel to impinge against said impingement wall.

* * * * *

UNITED STATES PATENT AND TRADEMARK OFFICE

CERTIFICATE OF CORRECTION

PATENT NO. : 5,035,358

DATED : July 30, 1991

INVENTOR(S) : Toshiyasu KATSUNO, et al.

It is certified that error appears in the above-identified patent and that said Letters Patent is hereby corrected as shown below:

Column 1, line 45, change "housing" to --housing body--.

Column 1, line 48, change "housing" to --housing body--.

Column 1, line 56, change "fuel and" to --fuel supply bore being fed into both the fuel air passages at the corresponding joining portions and--.

Column 1, line 57, delete "in".

Column 3, line 13, change "above" to --above,--.

Column 3, line 10, change "jointed" to --joined--.

Column 4, line 9, change "give" to --given--.

Column 4, line 58, change "FIGS." to --FIG.--.

Column 5, line 2, change "flow" to --air--.

Column 5, line 4, change "F1" to --$F_1$--.

Column 5, line 5, change "flow" to --air--.

Column 5, line 6, change "F2" to --$F_2$--.

Column 5, line 8, change "flown" to --blown--.

Column 5, line 9, change "F2." to --$F_2$.--.

Col. 5, line 22, change "air" to --flow--.

UNITED STATES PATENT AND TRADEMARK OFFICE

CERTIFICATE OF CORRECTION

PATENT NO. : 5,035,358

DATED : July 30, 1991

INVENTOR(S) : Toshiyasu KATSUNO, et al.

It is certified that error appears in the above-identified patent and that said Letters Patent is hereby corrected as shown below:

In the Claims:

Column 7, line 16, change "fix" to --axis--.

Column 7, line 32, change "housing" to --housing body--.

Column 7, line 44, change "flow" to --air--.

Column 8, line 6, change "nd" to --and--.

Column 8, line 49, change "whirl" to --swirl--.

Column 9, line 19, change "whirl" to --swirl--.

Col. 8, line 57, change "1" to --9--.

Column 9, line 1, change "passages" to --passage--.

Column 9, line 34, change "said ad" to --said--.

Column 10, line 5, change "form" to --from--.

Col. 10, line 17, change "body; a fuel" to --body;-- and insert --a fuel--.

Column 10, line 19, change "o" to --to--.

UNITED STATES PATENT AND TRADEMARK OFFICE

CERTIFICATE OF CORRECTION

PATENT NO. : 5,035,358

DATED : July 30, 1991

INVENTOR(S) : Toshiyasu KATSUNO, et al.

It is certified that error appears in the above-identified patent and that said Letters Patent is hereby corrected as shown below:

In the Claims:

Column 8, line 10, change "an  d" to --and--.

Signed and Sealed this

Twenty-fourth Day of August, 1993

*Attest:*

*Attesting Officer*

BRUCE LEHMAN

*Commissioner of Patents and Trademarks*